United States Patent [19]

Horn

[11] Patent Number: 4,721,254

[45] Date of Patent: Jan. 26, 1988

[54] ELECTROMAGNETICALLY ACTUATABLE FUEL-INJECTION VALVE

[75] Inventor: Martin Horn, Rotenburg, Fed. Rep. of Germany

[73] Assignee: VDO Adolf Schindling AG, Frankfurt am Main, Fed. Rep. of Germany

[21] Appl. No.: 805,086

[22] Filed: Dec. 4, 1985

[30] Foreign Application Priority Data

Dec. 6, 1984 [DE] Fed. Rep. of Germany ..... 3444452

[51] Int. Cl.[4] ..... F02M 51/06

[52] U.S. Cl. ..... 239/585; 251/129.16

[58] Field of Search ..... 239/533.2–533.12, 239/585; 251/129.16

[56] References Cited

U.S. PATENT DOCUMENTS

| | | | |
|---|---|---|---|
| 2,631,612 | 3/1953 | Buescher | 251/129.16 X |
| 2,910,249 | 10/1959 | Gunkel | 239/585 X |
| 4,274,598 | 6/1981 | Wilfert et al. | 239/585 |
| 4,384,681 | 5/1983 | Claxton | 239/585 |

FOREIGN PATENT DOCUMENTS

| | | | |
|---|---|---|---|
| 26060 | 4/1981 | European Pat. Off. | 239/533.9 |
| 2074232 | 10/1981 | United Kingdom | 251/129.16 |

*Primary Examiner*—Andres Kashnikow
*Assistant Examiner*—Mary Beth O. Jones
*Attorney, Agent, or Firm*—Martin A. Faber

[57] ABSTRACT

An electromagnetically actuatable fuel-injection valve for injection systems of internal combustion engines has a valve housing, a soft-iron core which is located within the valve housing and bears a fixed solenoid winding, and a valve closure plate which forms an armature and coaxially faces said core forming an air gap with it. This plate can be urged by a compression spring against an annular seat 10 which surrounds an outlet, and whose radially circumferential edge is guided in axial movement along a guide which correspondingly surrounds said edge. The valve closure plate has a coaxially protruding plug which extends through or into the outlet.

4 Claims, 2 Drawing Figures

ELECTROMAGNETICALLY ACTUATABLE FUEL-INJECTION VALVE

FIELD AND BACKGROUND OF THE INVENTION

The present invention relates to an electromagnetically actuatable fuel-injection valve for injection systems of internal combustion engines, the valve having a valve housing, a soft-iron core which is located within the valve housing and bears a stationary solenoid winding, and a valve closure plate which forms an armature and coaxially faces said core with the formation of an air gap. The plate can be urged by a compression spring against an annular seat which surrounds an outlet, and the radially circumferential edge of the plate being guided axially and movable along a guide which correspondingly surrounds said edge.

In such known fuel-injection valves, which have the advantage of simple and inexpensive construction, the fuel arrives along the outlet-side surface of the valve closure plate at the annular seat and flows from there through the outlet.

This has the disadvantage that the emergence of the fuel from the outlet can be influenced only to a limited extent by the shape of the outlet.

SUMMARY OF THE INVENTION

It is therefore the object of the present invention to create a fuel-injection valve of the above type which permits uniform and properly atomizable emergence of the fuel from the outlet with a well-defined angle of emergence.

This object is achieved in accordance with the invention whereby the valve closure plate has a coaxially protruding plug which extends through or into the outlet. By the plug with its suitably formed shape, the emergence of the fuel is shaped and atomized in the desired manner, while at the same time retaining the simple and inexpensive properties of the plate-valve construction.

In order to guide the plug centrally in the outlet, the valve closure plate is guided, by its circumferential edge. This edge can, however, jam in its guide and tilt, which leads to an oblique position of the plug in the outlet. In this way, however, the emergence of the fuel from the outlet is negatively affected. In order to avoid this, the valve closure plate can be provided on its radially circumferential edge with a barrel-shaped cross section, the edge being preferably ground.

An oblique position of the plug, and thus a negative influence on the jet, is also produced if the valve closure plate does not lift off simultaneously over its entire annular seat upon the opening or closing but, while resting on one side of the annular seat, merely permits a flow of fuel on the opposite side of the annular seat. Such an influencing of the jet is avoided in the manner that the radially-outer region of the outlet-side surface of the valve closure plate can rest against a support ring which is spaced radially from and concentrically surrounds the annular seat. The support ring is positioned at approximately the same distance from the valve closure plate as is the annular seat.

In order for there to be a dependable deflecting of the fuel flowing radially towards the annular seat into the outlet, the plug can have a transition in the shape of a concave fillet towards the outlet-side surface of the valve closure plate, the transition being preferably developed in the outlet side surface of the valve closure plate in the form of a recess.

If the valve closure plate is, for example, surface-hardened at the places which come into contact with other parts of the fuel-injection valve then, despite retention of the good magnetic properties of the valve closure plate which forms the armature, wear resulting from rubbing is substantially prevented. Such places are, for instance, the resting surfaces on the annular seat and the resting ring as well as the barrel-shaped radially surrounding edge.

BRIEF DESCRIPTION OF THE DRAWINGS

One embodiment of the invention is shown in the drawing and will be described in further detail below. In the drawings, wherein.

DETAILED DESCRIPTION OF THE PREFERRED EMBODIMENT

Figure 1:
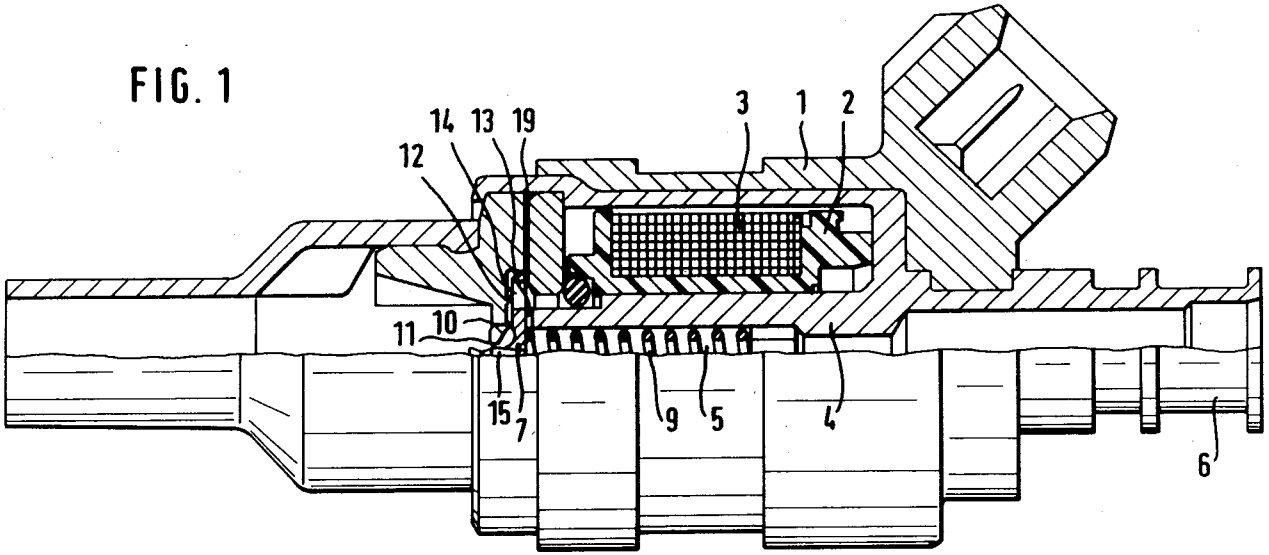
FIG. 1 is a side view of a fuel-injection valve, seen in half-section.
Figure 2:
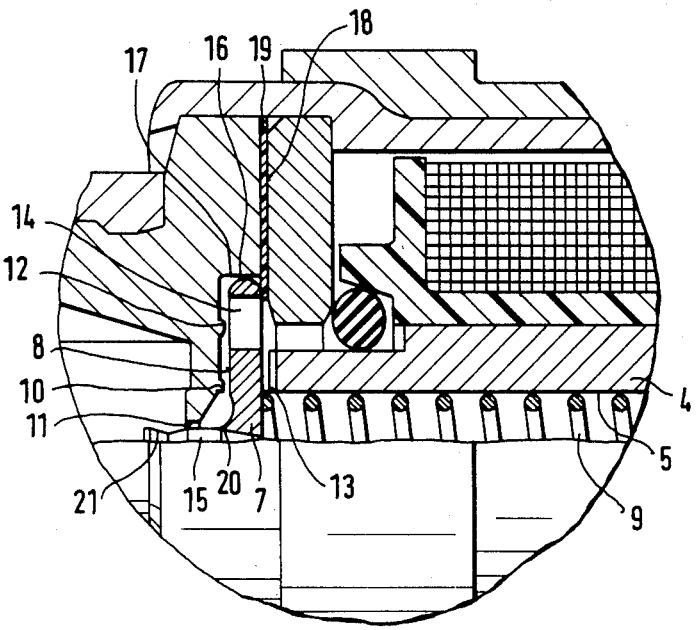
FIG. 2 shows on a larger scale a portion of the fuel-injection valve of FIG. 1.

The fuel-injection valve shown has a valve housing 1 within which there is arranged a coil form 2 bearing the magnet winding 3. Through the coil form 2 there extends a soft-iron core 4 which is provided with a passage bore 5, the end of which extends out of the valve housing 1 to form an inlet connection 6.

The other end of the soft-iron core 4 is located facing a valve closure plate 7, and forming an air gap therewith. The plate 7 forms an armature and has a sealing surface 8 on the side thereof opposite the soft-iron core 4.

By the action of a compression spring 9 which rests against the soft-iron core 4, the valve closure plate 7 is brought to rest against an annular seat 10 which protrudes axially towards the valve closure plate 7 and surrounds an outlet 11. The annular seat 10 is surrounded and spaced radially from a resting ring 12 which also protrudes axially toward the valve closure plate 7, and which is at a slightly greater distance from the valve closure plate 7 than the annular seat 10 is.

From the passage bore 5, the fuel passes, via radial passage grooves 13 at the end of the soft-iron core 4 and axial passage bores 14 in the valve closure plate 7 into the annular gap which is formed between the annular seat 10 and the resting ring 12. When the valve closure plate 7 is lifted off from the annular seat 10 against the force of the compression spring 9, the fuel can flow further to the outlet 11 and through the latter.

For the dependable coaxial guidance of the valve closure plate 7, which has a plug 15 which extends through the outlet 11, the closure plate is guided via its radially circumferential edge 16 in a correspondingly-shaped guide 17.

Due to the development of the edge 16 with a barrel-shaped cross section, the valve closure plate 7 cannot jam in its guide 17.

In order to prevent magnetic sticking of the valve closure plate 7 to its magnet side abutment surface 18, a plastic cover 19, developed as disk, is disposed on said surface 18.

The valve closure plate 7 is movable axially between the abutment surface 18, provided with the plastic cover 19 and the annular seat 10.

Since the resting ring 12 is located in the radially outer region of the valve closure plate 7, the valve closure plate 7 lifts off from the entire surface of the annular seat 10 upon the slightest opening movement, so that fuel will flow to the outlet 11 from all sides.

The plug 15 has a transition 20 in the shape of a concave fillet towards the outlet-side surface of the valve closure plate 7, this transition being developed so as to form a recess in the outlet side surface of the valve closure plate 7.

This concave-fillet-shaped transition 20 results in a dependable deflecting of the fuel into the outlet 11.

The plug 15 is developed with a deflection surface 21 of such symmetry of rotation that it reliably produces a given jet angle and good atomization of the fuel emerging from the outlet 11. The dependable guidance of the valve closure plate 7 in the guide 7 and on the resting ring 12 assures uniformity of the flow of the fuel.

I claim:

1. In an electromagnetically actuatable fuel-injection valve for injection systems of internal combustion engines, the valve having a valve housing, a soft-iron core located within the valve housing and carrying a stationary solenoid winding, an annular seat, a valve closure plate which forms an armature and coaxially faces said core with the formation of an air gap, a compression spring biasing said plate against said annular seat; and wherein said seat surrounds an outlet of said valve, a radially circumferential edge of said plate is guided axially and is movable along a guide of said valve, said valve correspondingly surrounding said edge, the improvement wherein the valve closure plate has a coaxially protruding plug, said plug extending at least partway into said outlet, said plug having a concave-fillet-shaped transition towards an outlet-side surface of said valve closure plate.

2. The fuel-injection valve according to claim 1, wherein said valve closure plate has a barrel-shaped cross section at a radially circumferential edge thereof.

3. The fuel-injection valve according to claim 1, further comprising an abutment against which said valve closure plate rests during opening of said valve, and a resting ring which concentrically surrounds the annular seat and is spaced radially from it, said ring and said seat extending approximately the same distance toward said abutment, and wherein said valve closure plate rests, via a radially outer region of its outlet-side surface, against said resting ring.

4. The fuel-injection valve according to claim 1, wherein the transition is formed in the outlet side surface of said valve closure plate to form a recess.

* * * * *